United States Patent [19]

Thead, Jr.

[11] 4,171,804

[45] Oct. 23, 1979

[54] RESPIRATORY EXERCISER AND THE LIKE

[76] Inventor: William H. Thead, Jr., 2259 Marann NE., Atlanta, Ga. 30345

[21] Appl. No.: 830,152

[22] Filed: Sep. 2, 1977

[51] Int. Cl.[2] ..... A63B 23/00

[52] U.S. Cl. ..... 272/99; 128/727; 73/744; 73/205 R

[58] Field of Search ..... 128/2.08, 208, 2.07, 128/2 C; 272/90 R; 73/744, 205 R

[56] References Cited

U.S. PATENT DOCUMENTS

| | | | |
|---|---|---|---|
| 3,754,546 | 8/1973 | Cooper | 128/2.08 |
| 4,060,074 | 11/1977 | Russo | 128/2.08 |

OTHER PUBLICATIONS

Chesebrough-Ponds, Inc., "UNIFLO", Jul. 1975.

*Primary Examiner*—Henry J. Recla
*Attorney, Agent, or Firm*—Fleit & Jacobson

[57] ABSTRACT

A disposable, compact respiratory exerciser having a housing defining a vertically upstanding chamber attached to a base. A first opening or aperture is defined in a lower portion of the housing and connects the interior of the housing with the ambient environment. A tube is connected between a stem that surrounds and extends from a second opening or aperture defined in another portion of the housing and a mouthpiece. Guide members are positioned on an interior wall of the housing and extend vertically from the base towards the top of the housing. The second opening communicates with an air passageway defined within one of the guide members by its interior walls and a wall of the housing. The passageway opens into or communicates with the interior of the housing near the top of the housing. A piston is loosely fitted within the housing on the guide members in such manner that withdrawal of air from the housing at or above a predetermined rate causes upward movement of the piston. Upward movement of the piston is limited so that communication is not blocked between the passageway and a space defined between the top of the piston and the top of the housing. Also, when the piston is in a lowermost position, at least a portion of the first aperture is in communication with a space defined between the piston and the bottom of the housing.

13 Claims, 8 Drawing Figures

RESPIRATORY EXERCISER AND THE LIKE

BACKGROUND OF THE INVENTION

This invention relates to a respiration exercising device and in particular to a device for enhancing inspiration for improvement of pulmonary performance.

One of the main causes for slow recovery of postoperative patients has been inadequate oxygen exchange in the lungs resulting from shallow breathing accompanying the use of general anesthesia. This condition can lead to partial or complete collapse of the lungs and to pneumonia.

Various methods have been proposed for preventing such pulmonary complications including instructions to the patient to breathe deeply, coughing exercises, and the use of blow bottles or the like to enhance expiration. Such methods of lung exercise have not been too successful since the alveoli are not adequately expanded.

Recognizing the greater benefits from methods employing positive pressure breathing, i.e., dilating bronchi and expanding unventilated alveoli by positive inhalation, several devices have been introduced to stimulate the patient in improving his inspiratory capacity. One such device is described in U.S. Pat. No. 3,754,546. A patient inhaling through a tube at the top of a cylinder causes a piston to rise until it makes contact with a preset post. As long as the patient continues to inhale, the contact causes a light to glow. By changing the setting of the post, greater or lesser inhalation capacity is required to obtain a light signal. Although the piston and cylinder portion is relatively inexpensive and disposable, the signal unit which is detachable is not, so that extensive use of the device becomes impracticable.

Another device which is in use consists of three light weight balls each in three vertical tubes interconnected at their tops and with a vent at the bottom of each tube. When the patient inhales through a breathing tube attached to the first tube, one or more balls will rise to the top of their respective tubes, depending on the strength of the inhalation. The device is inexpensive and disposable and has the capability of measuring three values of inspiratory capacity; however, in some instances the device is too complex.

Still another respiratory exerciser is disclosed in U.S. Pat. No. 4,025,070 which discloses an exerciser having a closed container with three openings. One of the openings is connected to a breathing tube. A second of the openings is connected to one end of an inverted U-shaped member. The other end of the U-shaped member includes an air flotatable member that rises in response to a decrease in pressure within the closed container. The third opening has a variable aperture which controls the rate of air flow. As with the device using the three light weight balls, this device can be too complex for some situations.

Objects of the present invention are, therefore, to provide a device for improving inspiration capacity, to provide a device which is useful for any individual regardless of his lung capacity, and to provide an improved device which is inexpensive, disposable and convenient to use, requiring a minimum of instruction and supervision.

SUMMARY OF THE INVENTION

In accordance with the present invention, a respiratory exercising device is provided having housing means defining a vertically upstanding chamber attached to a base. One or more guide members are positioned on the interior wall of the chamber and extend from the base towards the top of the chamber. The bottom of the base has protruding portions extending therefrom to form support members for the base so that one or more openings defined in the base are not blocked by the surface on which the device rest. The openings, which may also extend into a portion of the side walls of the chamber, allow communication between the interior of the chamber and the ambient environment. A second opening is defined in another portion of the chamber, preferably near its bottom, and is connected to an outwardly extending stem. One end of a tube is connected to the stem and the other end of the tube is connected to a mouthpiece. The second opening communicates with a passageway or space defined within one of the support members by a portion of the interior wall of the chamber and the interior walls of the guide member. The space communicates with the interior of the chamber near the top of the chamber. A piston is loosely fitted within the chamber for vertical movement on the one or more guide members. Inhalation of air by a user through the mouthpiece at a sufficient rate causes upward movement of the piston thus providing a visual indication of the amount of effort exerted by the user.

In one embodiment of applicant's invention, a portion of the side walls of the chamber near the bottom of the chamber protrude inwardly to stop downward movement of the piston thus preventing closure of any of the openings by the piston. Similarly, the side walls of the chamber near the top of the chamber include protrusions to limit upper movement of the piston. Alternatively, the chamber is closed with a separate top member having walls closer together than those of the chamber, the walls of the top limiting upward movement of the piston. Alternatively or in addition, tabular members or upstanding portions extend upwardly from the surface of the piston. The tops of these portions contact the top of the chamber thus limiting contact between the piston and the chamber.

The invention, and its objects and advantages, will become more apparent in the detailed description of the preferred embodiments presented below.

BREIF DESCRIPTION OF THE DRAWINGS

In the detailed description of the preferred embodiments of the invention presented below, reference is made to accompanying drawings, in which.

DESCRIPTION OF THE PREFERRED EMBODIMENTS

Because respiratory exercisers are well known, the present description will be directed in particular to elements forming part of, or cooperating more directly with, the present invention, and elements not specifically shown or described herein are understood to be selectable from those known in the art.

Figure 1:
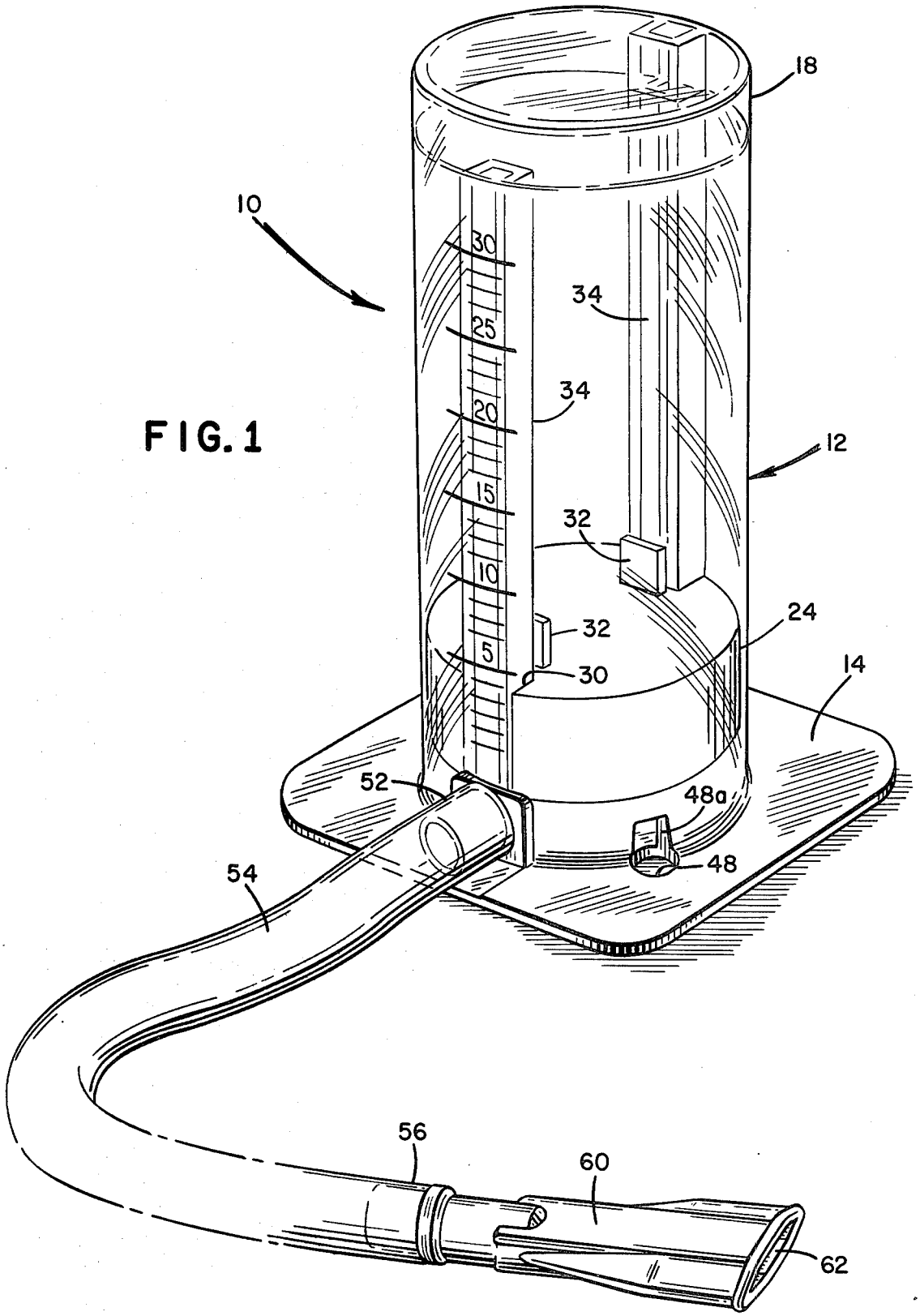
FIG. 1 is a perspective view of a device illustrating one embodiment of applicant's invention.
Figure 2:
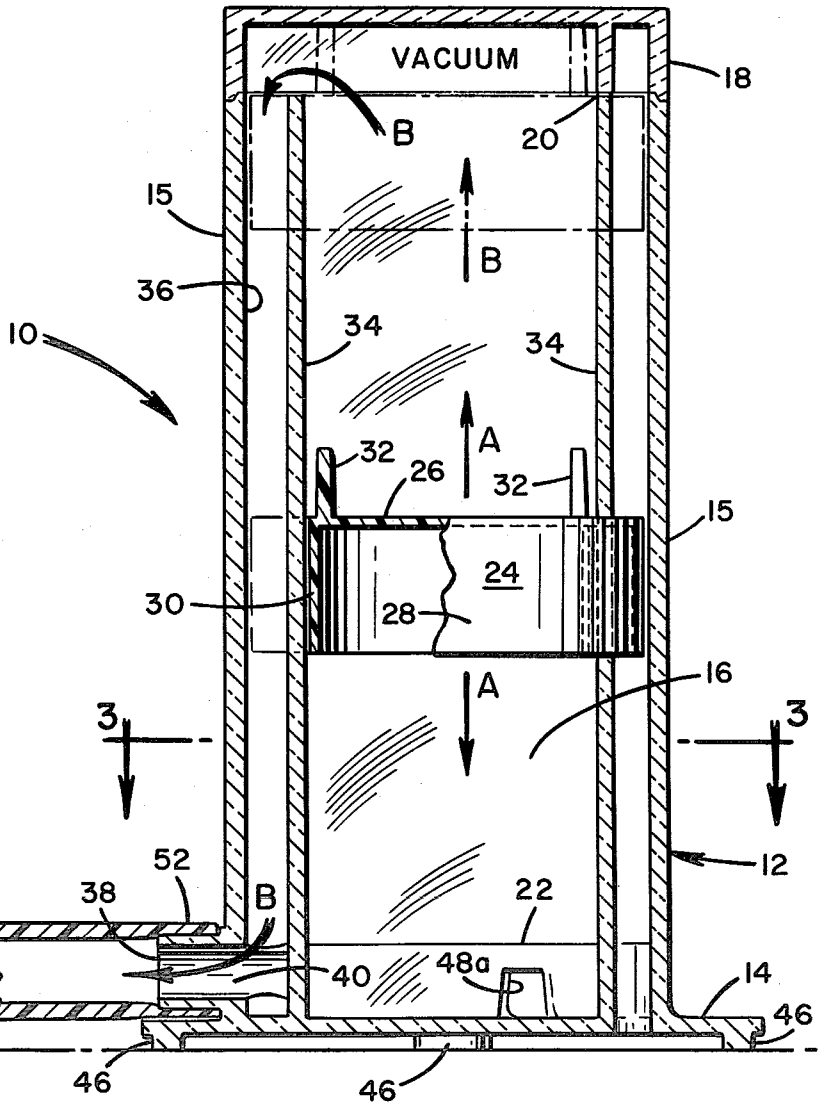
FIG. 2 is a longitudinal sectional view, partially in elevation, of the device illustrated in FIG. 1.
Figure 3:
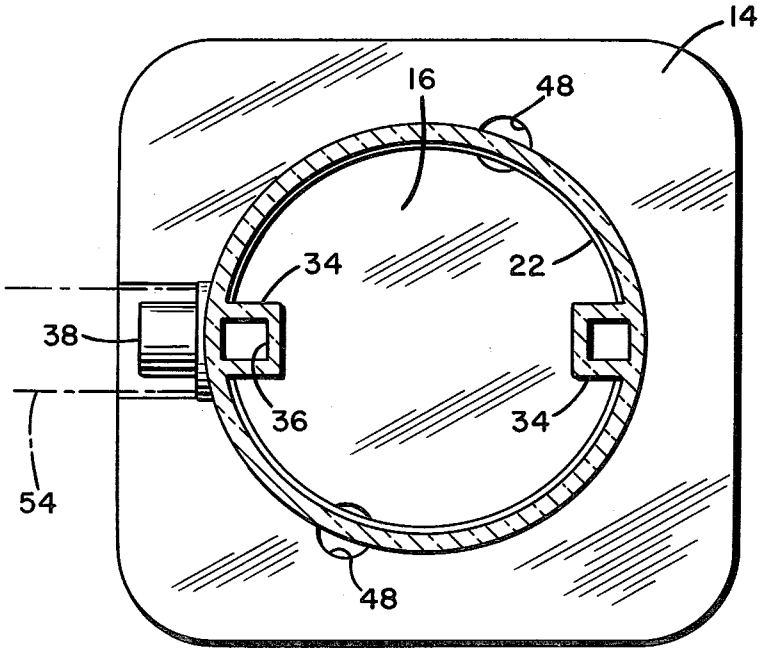
FIG. 3 is a cross-sectional view taken along line 3—3 of FIG. 2.

Referring now to the drawings, and to FIG. 1 in particular, one embodiment of the present invention is illustrated and will be described in connection with a respiratory exerciser, generally designated 10. The exerciser 10 includes a housing, generally designated 12 having a base portion 14 and walls 15 defining a vertically upstanding chamber 16 attached to the base. The chamber 16 is illustrated as having a generally cylindrical shape; however, it will be appreciated that chamber 16 can have any cross-section shape, such as, eliptical or rectangular. Chamber 16 includes indicia 17 on a side wall and is closed by a top member 18 which is either integrally moulded with the walls 15 or secured to their top. Where the top meets the walls, an inwardly extending lip portion 20 is formed. A bottom portion of walls 15 is inwardly flared as illustrated at 22. Alternatively, a lip or protruding portion similar to lip 20 is formed in bottom portions of the walls 15 near the base 14. The portions 20 and 22 limit upward and downward movement, respectively, of a piston member 24.

Figure 4:
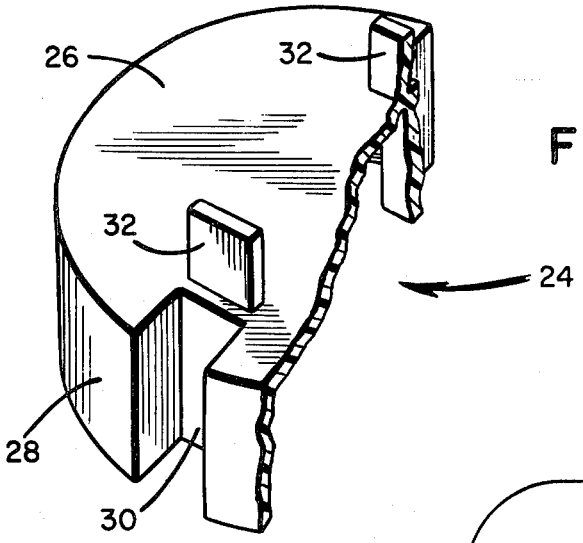
FIG. 4 is a perspective view, partially broken away, of a piston used with the device illustrated in FIG. 1.

As best illustrated in FIG. 4, piston member 24 has a flat upper surface 26 and downwardly extending side walls 28. Surface 26 is so shaped that piston member 24 is loosely fitted within the chamber 16 to allow restricted air flow between the walls 15 and 28. Piston 24 includes two channelways 30 defined by cutaway portions of surface 26 and side walls 28. Two columns, protruding or tabular portions 32 extend vertically upward from surface 26 and are designed to contact a portion of top 18 to prevent contact between surface 26 and the top. Although the columns 32 are illustrated as being spaced from the channelways 30, the columns 32 can be placed adjacent the channelways 30 to increase the bearing surface of the channelway. It is to be noted that the weight of piston member 24 is kept at a minimum by having the bottom of the member hollow. As shown in FIG. 1, piston member 24 is mounted in chamber 16 for vertical movement, as indicated by the arrows A, in such manner that the channelways 30 ride on two guideways of channels 34. The guideways 34 are either moulded integral with the walls 15 or rigidly affixed thereto with cement or other means.

Figure 7:
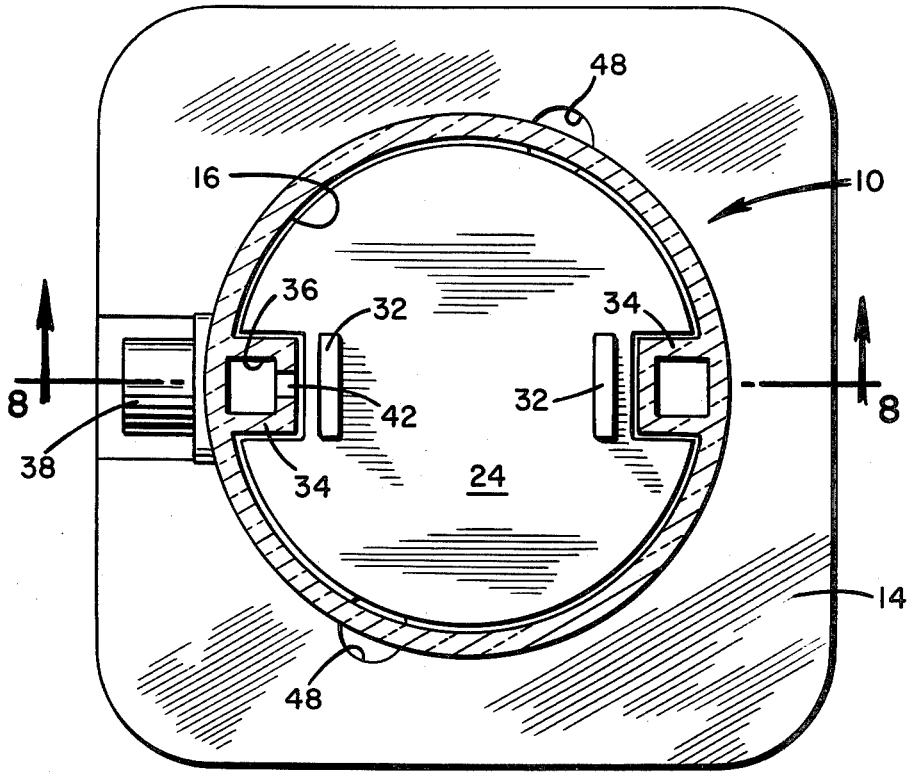
FIG. 7 is a cross-sectional view taken along line 7—7 of FIG. 8 of a device illustrating another embodiment of applicant's invention.
Figure 8:
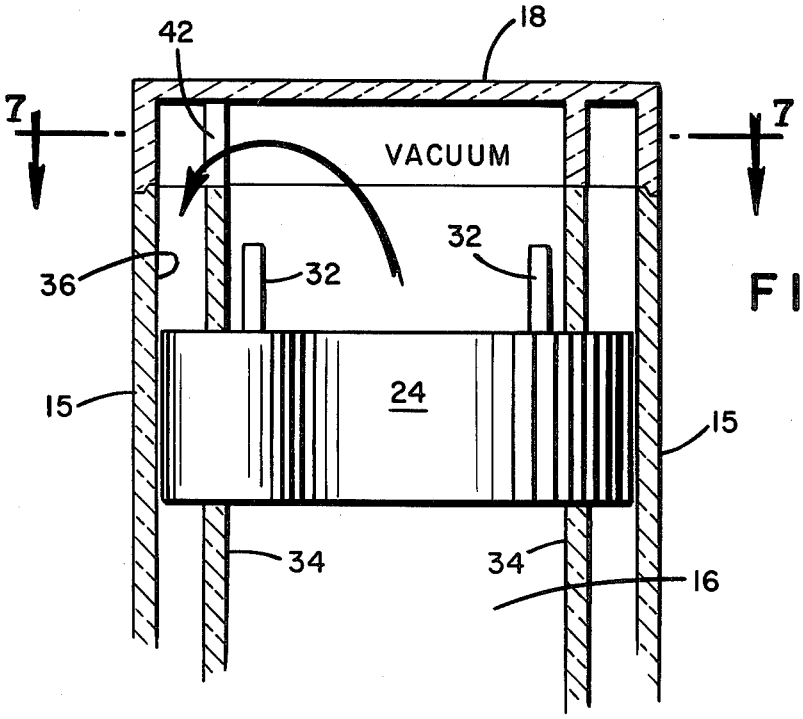
FIG. 8 is a partial longitudinal sectional view, partially in elevation, taken along line 8—8 of FIG. 7.

At least one of the guideways 34 is hollow and defines with a portion of the walls 15 a vertically extending passageway or space 36. Space 36 communicates with the interior of chamber 16 near the top of the chamber and communicates with the ambient environment through a stem 38 surrounding an opening or aperture 40 formed in a bottom portion of housing 12. As shown in FIG. 1, the communication between space 36 is obtained by terminating the top of guideway 34 short of the top 18. Alternatively, as illustrated in FIGS. 7 and 8, space 36 communicates with the interior of chamber 16 through an opening or aperture 42 formed in a portion of the top of guideway 34. Since upward movement of piston 24 is limited by either lip 20 or columns 32, passageway 36 is always in communication with a space defined between the top of the piston and the top of the housing.

Figure 5:
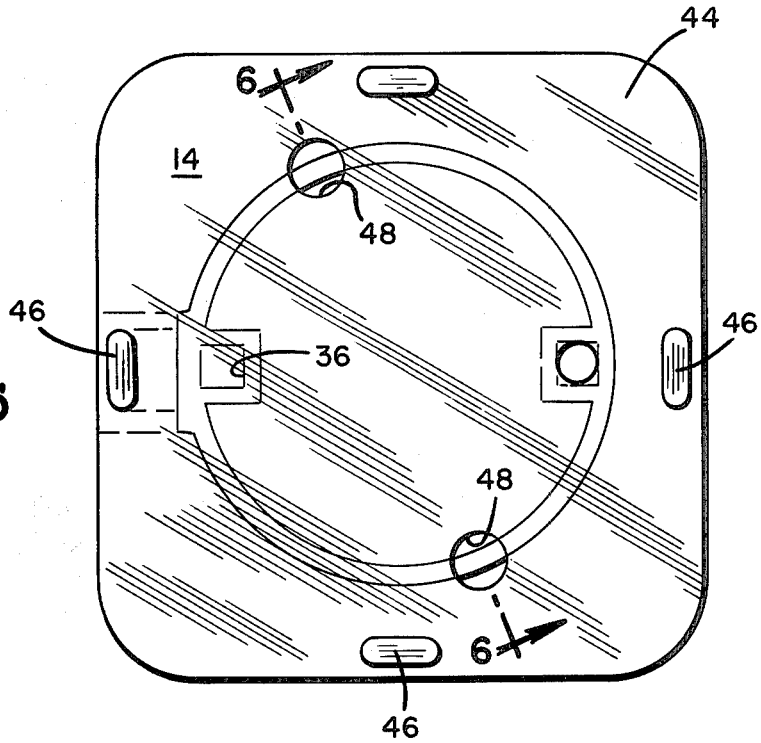
FIG. 5 is a plan view of the bottom of the device illustrated in FIG. 1.
Figure 6:
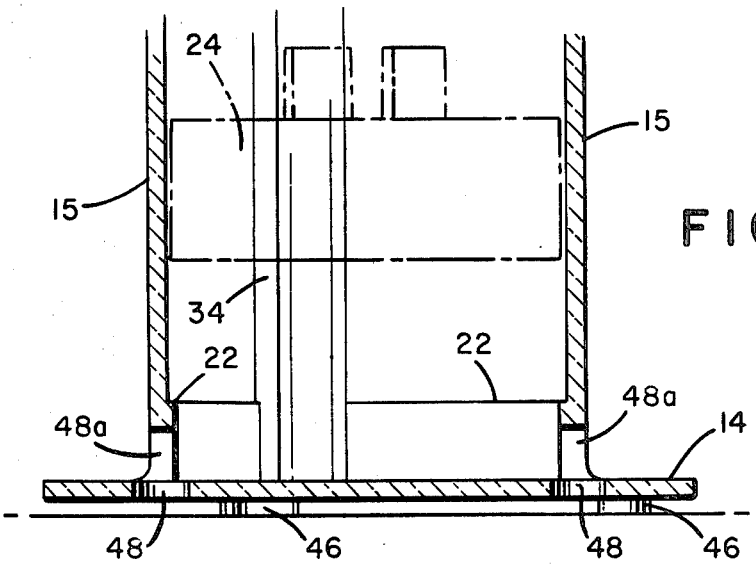
FIG. 6 is a cross-sectional view taken along line 6—6 of FIG. 5.

Turning now to the base portion 14, as best shown in FIG. 5, the bottom surface 44 of base portion 14 includes a plurality of protruding portions or feet 46 which keep the bottom surface spaced from the surface on which the respiratory exerciser 10 rests. Feet 46 are integrally moulded with bottom surface 44 or are attached thereto after moulding of the main portions of the housing 12. Bottom surface 44 is spaced from the supporting surface to prevent blockage of openings or apertures 48 which extend through base portion 14 to communicate with the interior of chamber 16. Apertures 48, as illustrated in FIG. 1, include portions **48*a* formed in portions of the bottom of walls 15. If desired, the size of apertures 48 can be varied to control the rate at which air enters chamber 16. Since a portion of the aperture 48 is included in base portion 14, a lower portion of chamber 16 will always be in communication with the ambient environment, even if side walls 28 of piston member 24 contact the top of base portion 14**.

As previously described, a stem 38 surrounds and extends outwardly from an opening or aperture 40 formed in walls 15. One end 52 of a tubing member 54 surrounds or extends into the outer end of stem 38. The other end 56 of tubular member 54 surrounds or extends into an end 58 of a mouthpiece 60. The other end 62 of the mouthpiece is contoured to facilitate its retention in the mouth of a user.

In operation, the respiratory exerciser 10 is placed in a desired position, preferably an upright position, and a user exhales normally and then places his or her lips tightly around the mouthpiece. The user then takes a deep breath withdrawing air from chamber 16, as indicated by arrows B, and raises the piston 24 as high as possible within the chamber 16. Air simultaneously enters chamber 16 through apertures 48. By checking the marking indicia 17 on the side of chamber 16, the user and attending medical personnel have a visual indication of the amount of breathing effort being exerted. By recording levels reached over a period of time, it is possible to obtain a record of the progress of the user. After a period of use, the mouthpiece 60 is removed from tubing member 54 and protected from contamination. Since only the mouthpiece 60 comes in contact with the patient, only this part of the exerciser must be protected from contamination.

It is well recognized by those skilled in the art that numerous modifications of the disclosed exerciser would fall within the spirit and scope of the disclosed invention. As previously described, the respiratory exerciser is a flow rate dependent incentive deep breathing exerciser designed to promote deep breathing in medical indicated situations. A preferred embodiment of the exerciser is constructed of break resistent plastic to be portable, light weight, and easy to handle.

The invention has been described in detail with particular reference to preferred embodiments thereof, but it will be understood that variations and modifications can be affected within the spirit and scope of the invention.

I claim:

1. A respiratory exercising device comprising:

housing means for defining a vertically upstanding enclosed chamber having a base, side wall and top;

guide means for defining a guide surface inside said enclosed chamber, said guide means being positioned on the side wall of said chamber and projecting inwardly therefrom in such manner that an exterior portion of said guide means defines the guide surface, said guide means having interior walls cooperating with said side wall to define an air passageway;

piston means mounted on said guide means for vertical movement in said chamber, said piston means being loosely fitted in said housing to restrict air flow within said chamber; means for limiting downward movement of said piston means;

first aperture means defined in said housing means below the lowermost position of said piston means for communicating the interior of said chamber with the ambient environment;

second aperture means defined in said housing and extending from a first end of said air passageway to the exterior of said housing means, the other end of said air passageway communicating with the interior of said chamber near its top in such manner that when air is withdrawn through said second aperture means from said air passageway said piston means is adapted to rise vertically on said guide means; and connection means adapted for establishing communication between said second aperture means and a user of the exercising device.

2. A device as claimed in claim 1 wherein said connection means includes a stem extending from said second aperture means and inhaling means including tubing means and a mouthpiece, the tubing means connecting said mouthpiece to said stem so that inhalation through said mouthpiece causes said piston means to move vertically upward on said guide means.

3. A device as claimed in claim 1 wherein said piston means includes upwardly extending portions for limiting upward movement of said piston means.

4. A device as claimed in claim 1 wherein said first aperture means includes a first portion defined by said wall means connected to a second portion formed in said base.

5. A device as claimed in claim 1 wherein said second aperture means is defined in a lower portion of said wall means.

6. A device as claimed in claim 5 wherein said base includes means for spacing the portion of said base containing said first aperture means from a surface supporting said exercising device.

7. A device as claimed in claim 1 wherein said first aperture means includes two apertures defined in said housing below the lowermost position of said piston means.

8. A device as claimed in claim 1 wherein said piston means includes a top surface having downwardly extending walls attached to peripheral portions thereof, said walls cooperating with said walls means to guide vertical movement of said piston means.

9. A device as claimed in claim 1 wherein said means for limiting downward movement comprises means projecting inwardly from a lower portion of said wall means.

10. A device as claimed in claim 1 wherein said guide means projects radially inward from said interior wall.

11. A respiratory exercising device comprising:

a base;

a vertically extending closed chamber having a wall extending between closed and open ends, the open end being attached to the base;

two vertically extending guide members positioned on and extending inwardly from opposite interior walls of the chamber, interior walls of one of the guide members cooperating with a portion of the interior walls of the chamber to define an air passageway, the air passageway communicating with an upper portion of the interior of the chamber;

piston means mounted for movement in said chamber on said guide members and being loosely fitted within said chamber, said piston means including two portions extending from an upper surface of the piston means for limiting upward movement of the piston means, said wall of said chamber having an inwardly protruding portion for limiting downward movement of said piston means;

first aperture means including two openings defined in said base and a portion of said housing for communicating the interior of said housing with the ambient environment, said first aperture means being positioned below said piston means when said piston means is located in its lowermost position;

second aperture means defined in said chamber for communicating the exterior with the interior of said air passageway; and inhaling means including a mouthpiece and tubing means for connecting said second aperture means and said mouthpiece, said tubing means being connected between said mouthpiece and said second aperture means in such manner that, when air is inhaled through said mouthpiece, air is also withdrawn from the interior of said chamber and said piston means moves vertically upward, the amount of upward movement of said piston means being determined by the rate at which air is withdrawn through said mouthpiece.

12. A device as claimed in claim 11 further comprising stem means positioned between said tubing means and said second aperture means for connecting said tubing means and said second aperture means.

13. A device as claimed in claim 11 wherein said guide members extend radially inward from said interior walls.

* * * * *